US009692151B2

(12) United States Patent
Kunieda et al.

(10) Patent No.: US 9,692,151 B2
(45) Date of Patent: Jun. 27, 2017

(54) COAXIAL CONNECTOR WITH SWITCH

(71) Applicant: SMK Corporation, Tokyo (JP)

(72) Inventors: Hironori Kunieda, Tokyp (JP); Katsuhisa Serizawa, Tokyo (JP)

(73) Assignee: SMK Corporation, Tokyo (JP)

( * ) Notice: Subject to any disclaimer, the term of this patent is extended or adjusted under 35 U.S.C. 154(b) by 122 days.

(21) Appl. No.: 14/181,496

(22) Filed: Feb. 14, 2014

(65) Prior Publication Data

US 2014/0315427 A1 Oct. 23, 2014

(30) Foreign Application Priority Data

Apr. 22, 2013 (JP) ..... 2013-089003

(51) Int. Cl.

| | |
|---|---|
| ***H01H 71/08*** | (2006.01) |
| ***H01R 9/05*** | (2006.01) |
| ***H01R 13/703*** | (2006.01) |
| ***H01R 24/46*** | (2011.01) |
| *H01R 24/50* | (2011.01) |

(52) U.S. Cl.

CPC ..... *H01R 9/0527* (2013.01); *H01R 13/7033* (2013.01); *H01R 24/46* (2013.01); *H01H 71/08* (2013.01); *H01R 24/50* (2013.01); *H01R 2201/02* (2013.01)

(58) Field of Classification Search

CPC .... H01R 13/70; H01R 24/46; H01R 13/7033; H01R 13/658

USPC ..... 200/51.1, 51 R, 51.09; 439/63, 944, 188

See application file for complete search history.

(56) References Cited

U.S. PATENT DOCUMENTS

| | | | | |
|---|---|---|---|---|
| 5,174,775 | A * | 12/1992 | Birch | 439/188 |
| 7,008,247 | B2 * | 3/2006 | Anzai | 439/188 |
| 7,458,834 | B1 * | 12/2008 | Chen | H01R 13/11 439/188 |
| 7,682,173 | B2 * | 3/2010 | Zhu et al. | 439/188 |
| 2003/0236013 | A1 * | 12/2003 | Hu et al. | 439/188 |
| 2004/0121625 | A1 * | 6/2004 | Togashi | 439/63 |
| 2006/0046547 | A1 * | 3/2006 | Matsuo | 439/188 |

FOREIGN PATENT DOCUMENTS

| | | |
|---|---|---|
| JP | 3079466 B2 | 8/2000 |
| JP | 3337650 B2 | 10/2002 |
| JP | 4220446 B2 | 2/2009 |

* cited by examiner

*Primary Examiner* — Edwin A. Leon
*Assistant Examiner* — Ahmed Saeed
(74) *Attorney, Agent, or Firm* — Locke Lord LLP

(57) ABSTRACT

Provided is a switch attached coaxial connector that improves an isolation characteristic between a common terminal and a closed terminal. In a normal state where a coaxial plug is not connected to the switch attached coaxial connector, a movable contact portion biased by a leaf spring piece portion elastically contacts a fixed contact piece portion so that a closed terminal and a common terminal are electrically connected to each other. When the coaxial plug is connected to the switch attached coaxial connector, the movable contact portion moves rearward from the fixed contact piece portion by the plug pin abutting against a plug contact portion so that the contact with respect to the fixed contact piece portion is disconnected and the electrical connection of the common terminal is switched from the closed terminal to the plug pin.

10 Claims, 9 Drawing Sheets

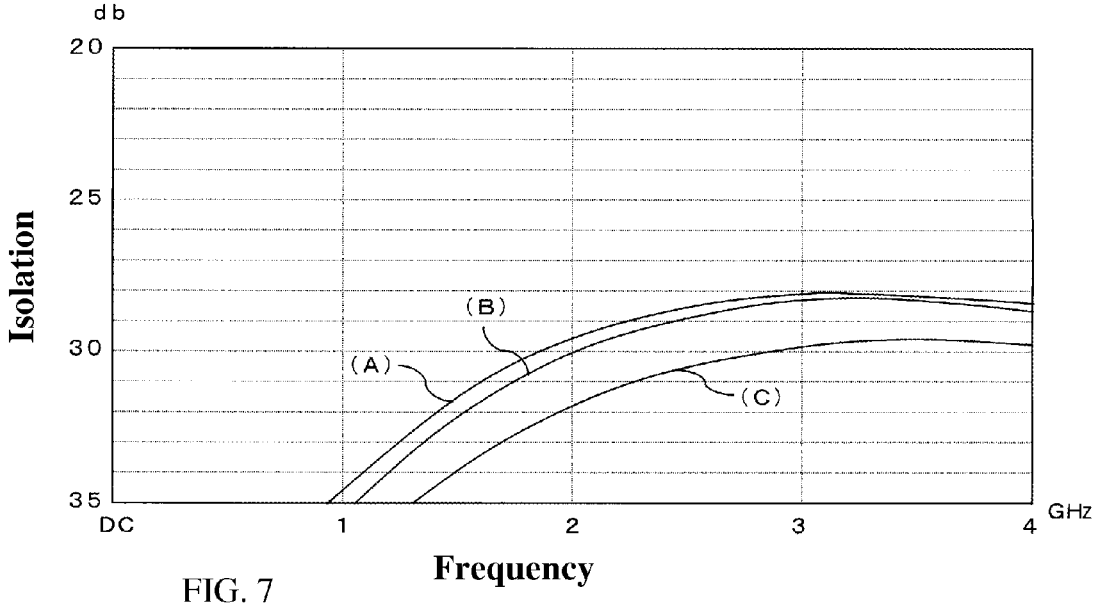
FIG. 7
FIG. 8A
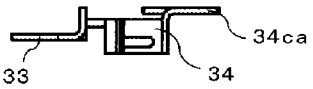
30
FIG. 8B
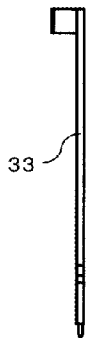
FIG. 8C
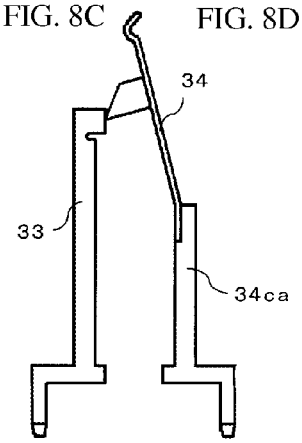
FIG. 8D
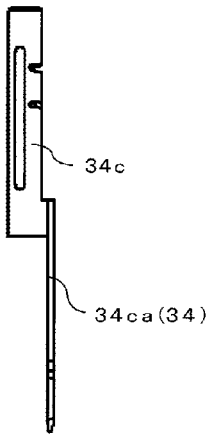

40

50

FIG. 11A
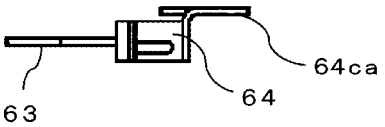
FIG. 11B
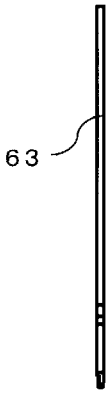
FIG. 11C
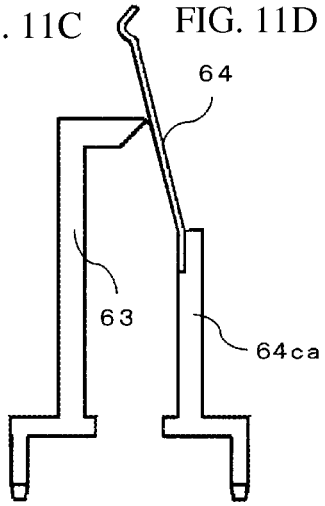
FIG. 11D
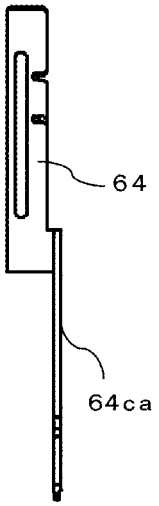
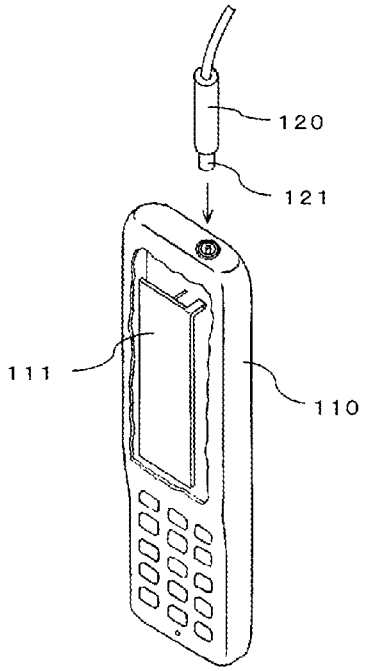
FIG. 12

COAXIAL CONNECTOR WITH SWITCH

CROSS REFERENCE SECTION

This application claims priority under to Japanese patent application JP2013-089003 under 35 U.S.C. §119(a) filed on Apr. 22, 2013, which is incorporated by reference herein in its entirety.

BACKGROUND

1. Field of the Invention

The present invention relates to coaxial connectors which switches a connection of a common terminal from a closed terminal to a plug pin of a coaxial plug by the connection to the coaxial plug connected to a terminal such as a coaxial cable.

2. Description of Related Art

Conventional coaxial connectors can be used in, for example, portable communication devices (e.g., mobile phones) and in an environment where incoming signal strength is poor. For example, when a plug pin of a coaxial plug is connected to an external antenna, the coaxial connector switches a circuit connection of the mobile device from the embedded internal antenna to the external antenna.

However, high-frequency signals which flows from the internal antenna leaks to the circuit connection through a floating capacitance between, for example, a closed terminal and a common terminal of the coaxial connector. Notably, the floating capacitance is inversely proportional to the distance between the closed terminal and the common terminal, but is proportional to the facing area between both terminals. Accordingly, in the conventional coaxial connector in which the facing area between the closed terminal and the common terminal is fixed and the distance therebetween is long, the isolation characteristic remains poor.

SUMMARY

The invention is made in view of these problems, and it is an object of the invention to provide a coaxial connector with a switch that improves an isolation characteristic between a common terminal and a closed terminal.

In order to achieve the above-described object, according to a first aspect, there is provided a switch attached coaxial connector with a switch including: an insulation housing that is provided with a terminal accommodation chamber and an insertion hole through which a plug pin of a coaxial plug is insertable into or separable from the terminal accommodation chamber from the upside thereof; a closed terminal that is formed of a conductive plate piece and is integrally provided with a fixed contact piece portion and a positioning piece portion supported by the insulation housing in the plug pin insertion and separation direction inside the terminal accommodation chamber; and a common terminal that is formed of a conductive plate piece and is integrally provided with a plug contact portion which is disposed below the insertion hole, a movable contact portion which is movable close to or away from the fixed contact piece portion of the closed terminal, and a leaf spring piece portion which is supported by the insulation housing in a cantilevered manner along the plug pin insertion and separation direction inside the terminal accommodation chamber and biases the movable contact portion toward the fixed contact piece portion, wherein in a normal state where the coaxial plug is not connected to the switch attached coaxial connector, the movable contact portion biased by the leaf spring piece portion elastically contacts the fixed contact piece portion so that the closed terminal and the common terminal are electrically connected to each other, wherein when the coaxial plug is connected to the switch attached coaxial connector, the movable contact portion moves rearward from the fixed contact piece portion by the plug pin abutting against the plug contact portion so that the contact with respect to the fixed contact piece portion is disconnected and the electrical connection of the common terminal is switched from the closed terminal to the plug pin, and wherein the positioning piece portion of the closed terminal is supported by the insulation housing so that the plate thickness direction of the conductive plate piece is parallel to a facing surface facing the common terminal in the movable direction of the movable contact portion.

Since the positioning piece portion of the closed terminal does not need to be elastically deformed or does not need to be disposed along the facing surface with respect to the movable contact portion so as to contact the movable contact portion of the common terminal even when there is a positional deviation therebetween, the positioning piece portion may be supported by the insulation housing so that the plate thickness direction of the conductive plate piece is parallel to the facing surface facing the common terminal. In the closed terminal which is supported so that the plate thickness direction of the conductive plate piece is parallel to the facing surface facing the common terminal, only the side surface of the plate thickness direction faces the common terminal. Accordingly, the facing area between both terminals is reduced, and hence the floating capacitance therebetween is likewise reduced.

In the switch attached coaxial connector according to a second aspect, the leaf spring piece portion of the common terminal is provided with an intersection plate portion in which the plate thickness direction of the conductive plate piece is parallel to the facing surface.

In the intersection plate portion, since the plate thickness direction of the conductive plate piece is perpendicular to the movement direction of the movable contact portion, only the side surface of the plate thickness direction faces the closed terminal, and hence the facing area between the common terminal and the closed terminal further reduces.

In the switch attached coaxial connector according to a third aspect, the movable contact portion of the common terminal extends to the intersection plate portion on that the plate thickness direction is parallel to the facing surface.

Since the fixed contact portion faces the side surface of the plate thickness direction of the movable contact portion moving closest to the closed terminal by the movement close to or away from the fixed contact portion, the floating capacitance between the fixed contact piece portion and the movable contact portion moving closest thereto reduces.

In the switch attached coaxial connector according to a fourth aspect, the positioning piece portion of the closed terminal is supported by the insulation housing at the side deviated from a portion facing the common terminal in the movable direction of the movable contact portion, and the fixed contact piece portion is formed so as to be orthogonally bent to a portion facing the movable contact portion from the positioning piece portion.

Since the positioning piece portion of the closed terminal is supported by the side of the portion facing the common terminal so that only the fixed contact piece portion faces the common terminal, the facing area with respect to the common terminal reduces, and hence the floating capacitance between the common terminal and the closed terminal further reduces.

In the switch attached coaxial connector according to a fifth aspect, the fixed contact piece portion of the closed terminal extends to the positioning piece portion so that the plate thickness direction is parallel to the facing surface.

Since the plate thickness direction of the conductive plate piece of the fixed contact piece portion is parallel to the facing surface, only the side surface of the plate thickness direction faces the movable contact portion, and hence the floating capacitance between the fixed contact piece portion and the movable contact portion moving closest thereto reduces.

In the switch attached coaxial connector according to a sixth aspect, when one side of the common terminal is connected to a transmitting and receiving circuit of a portable communication device so that the coaxial plug is connected to the switch attached coaxial connector, the electrical connection of the other side of the common terminal is switched from the closed terminal connected to an internal antenna to the plug pin connected to an external antenna.

When the external antenna is connected to the portable communication device, the antenna signal from the internal antenna does not leak to the transmitting and receiving circuit.

According to the invention of the first aspect, it is possible to improve the isolation characteristic with respect to the common terminal just by adjusting the direction where the closed terminal formed of the conductive plate piece is supported by the insulation housing.

According to the invention of the second aspect, since only the side surface of the plate thickness direction of the intersection plate portion is disposed in the movement direction of the movable contact portion, the facing area with respect to the closed terminal disposed in the movement direction reduces, and hence the isolation characteristic between the common terminal and the closed terminal may be further improved.

According to the invention of the third aspect, since the facing area between the fixed contact portion and the movable contact portion moving closest thereto reduces, the isolation characteristic between the common terminal and the closed terminal is drastically improved.

According to the invention of the fourth aspect, since the positioning piece portion as the main portion of the closed terminal is deviated from the facing portion with respect to the common terminal, the isolation characteristic between the common terminal and the closed terminal may be further improved.

According to the invention of the fifth aspect, since only the side surface of the plate thickness direction of the fixed contact piece portion being closest to the movable contact portion faces the movable contact portion, the isolation characteristic between the common terminal and the closed terminal may be further improved.

According to the invention of the sixth aspect, no cross-talk with respect to the internal antenna occurs when the external antenna is connected to the portable communication device.

BRIEF DESCRIPTION OF DRAWINGS

FIG. 7 is a graph illustrating a relation between an isolation characteristic and a direction of arranging the closed terminal and the common terminal by a comparison;

FIGS. 8A to 8D illustrate an arrangement relation between a closed terminal 33 and a common terminal 34 supported by an insulation housing 2 of a switch attached coaxial connector 30 according to a second embodiment, where FIG. 8A is a plan view illustrating both terminals, FIG. 8B is a left side view illustrating the closed terminal 33, FIG. 8C is a front view illustrating both terminals, and FIG. 8D is a right side view illustrating the common terminal 34;

FIG. 9A is a plan view illustrating both terminals, FIG. 9B is a left side view illustrating the closed terminal 43, FIG. 9C is a front view illustrating both terminals, and FIG. 9D is a right side view illustrating the common terminal 44;

FIG. 10 illustrates an arrangement relation between a closed terminal 53 and a common terminal 54 supported by an insulation housing 2 of a switch attached coaxial connector 50 according to a fourth embodiment, where

FIG. 11 illustrates an arrangement relation between a closed terminal 63 and a common terminal 64 supported by an insulation housing 2 of a switch attached coaxial connector 60 according to a fifth embodiment, where FIG. 11A is a plan view illustrating both terminals, FIG. 11B is a left side view illustrating the closed terminal 63, FIG. 11C is a front view illustrating both terminals, and FIG. 11D is a right side view illustrating the common terminal 64;

FIG. 12 is a partially cut-away perspective view illustrating a cellular phone 110 having a switch attached coaxial connector embedded therein;

DETAILED DESCRIPTION

Description of Reference Numerals

Figure 1:
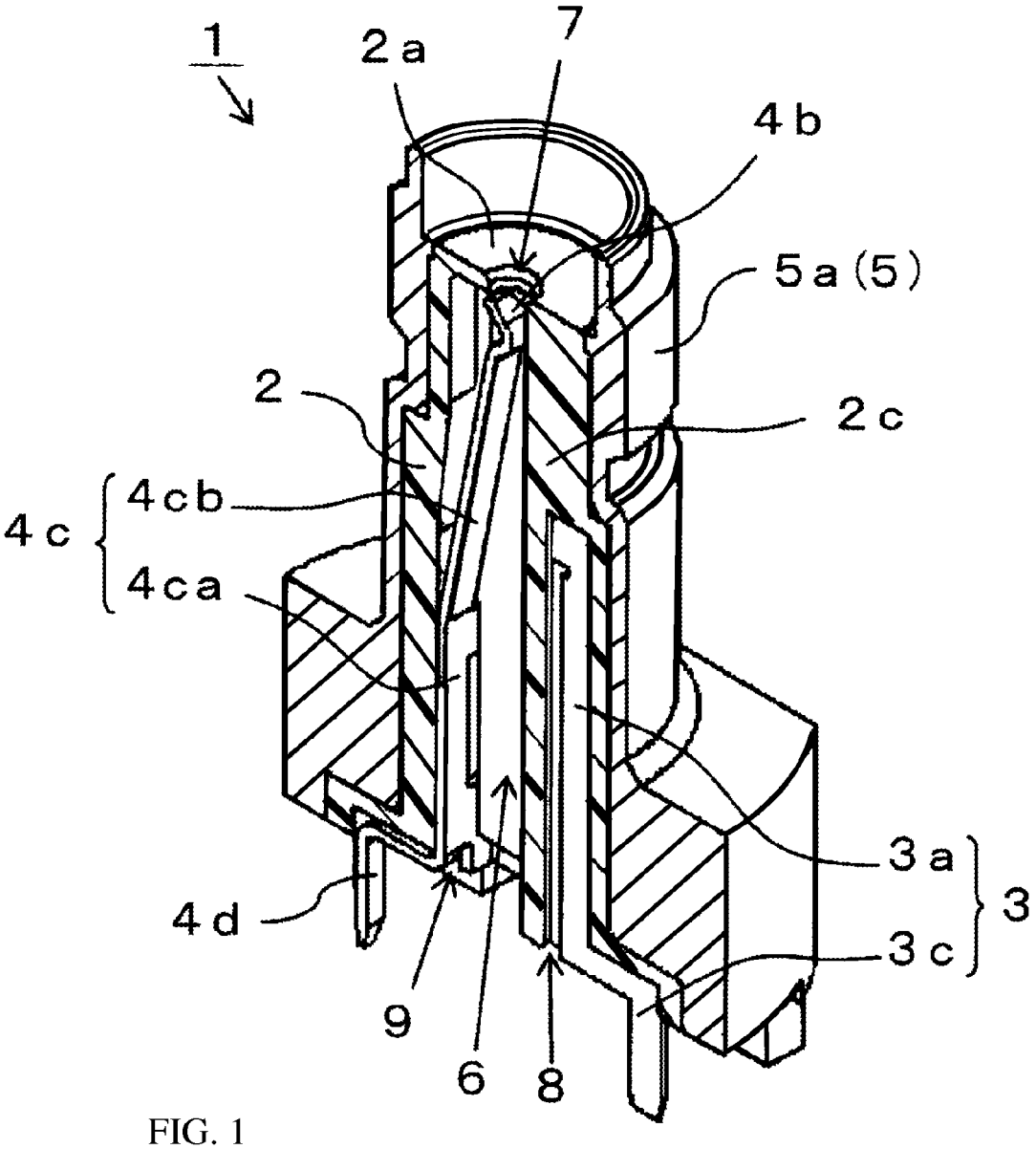
FIG. 1 is a cross-sectional perspective view illustrating a switch attached coaxial connector 1 according to an embodiment of the invention that is cut in a direction in which a closed terminal 3 and a common terminal 4 face each other.

1 switch attached coaxial connector
2 insulation housing
3 closed terminal
3*a* positioning piece portion
3*b* fixed contact piece portion
4 common terminal

4*a* movable contact portion
4*b* plug contact portion
4*c* leaf spring piece portion
4*ca* fixed piece portion
6 terminal accommodation chamber
7 insertion hole
30 switch attached coaxial connector according to second embodiment
33 closed terminal
34 common terminal
34*ca* intersection plate portion
40 switch attached coaxial connector according to third embodiment
43 closed terminal
44 common terminal
50 switch attached coaxial connector according to fourth embodiment
53 closed terminal
54 common terminal
60 switch attached coaxial connector according to fifth embodiment
63 closed terminal
64 common terminal
64*ca* intersection plate portion
120 coaxial plug
121 plug pin As discussed above, conventional coaxial connectors provide poor isolation characteristics. For example, as illustrated in FIG. 12, a coaxial connector is embedded in, for example, a portable communication device such as a cellular phone 110, and is used in an environment in which incoming signal strength is poor. When a plug pin 121 of a coaxial plug 120 connected to an external antenna inserted into the coaxial connector, the coaxial connector generally switches a transmitting and receiving circuit connection inside the device connected to an embedded internal antenna 111 to the external antenna.

Figure 13:
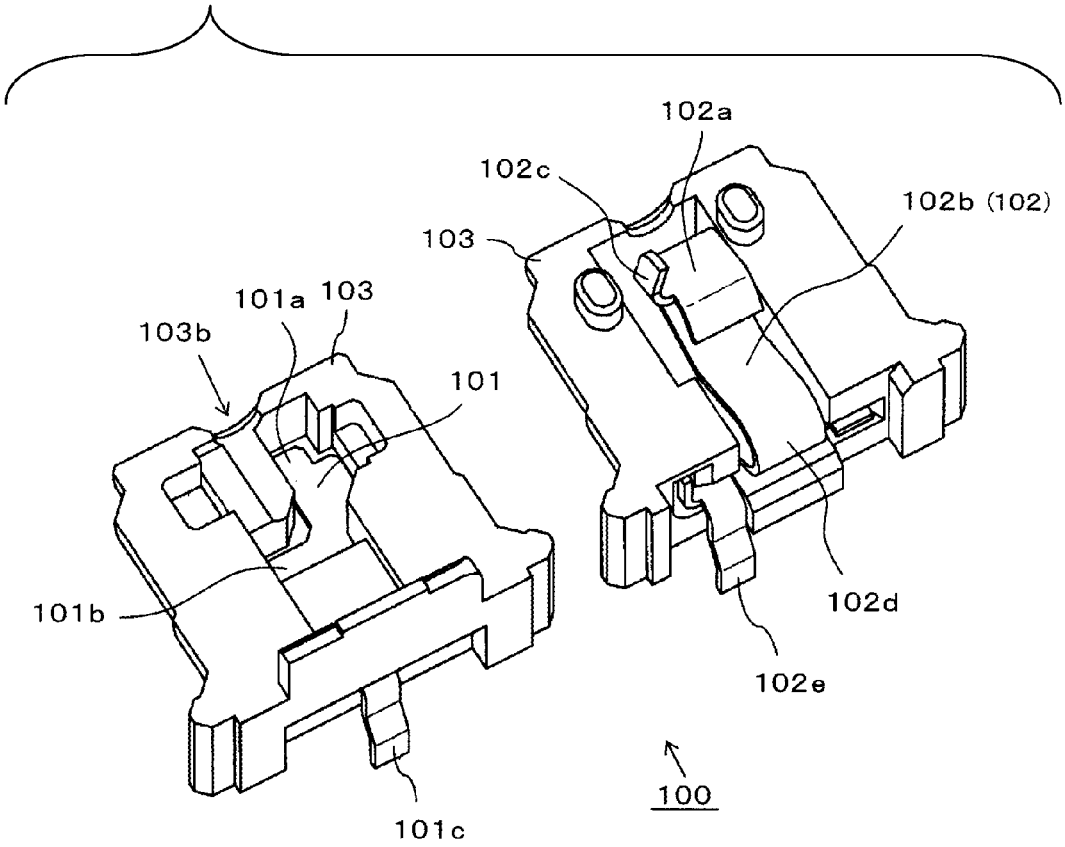
FIG. 13 PRIOR ART
FIG. 13 is a longitudinal sectional view illustrating a conventional switch attached coaxial connector 100.
Figure 14:
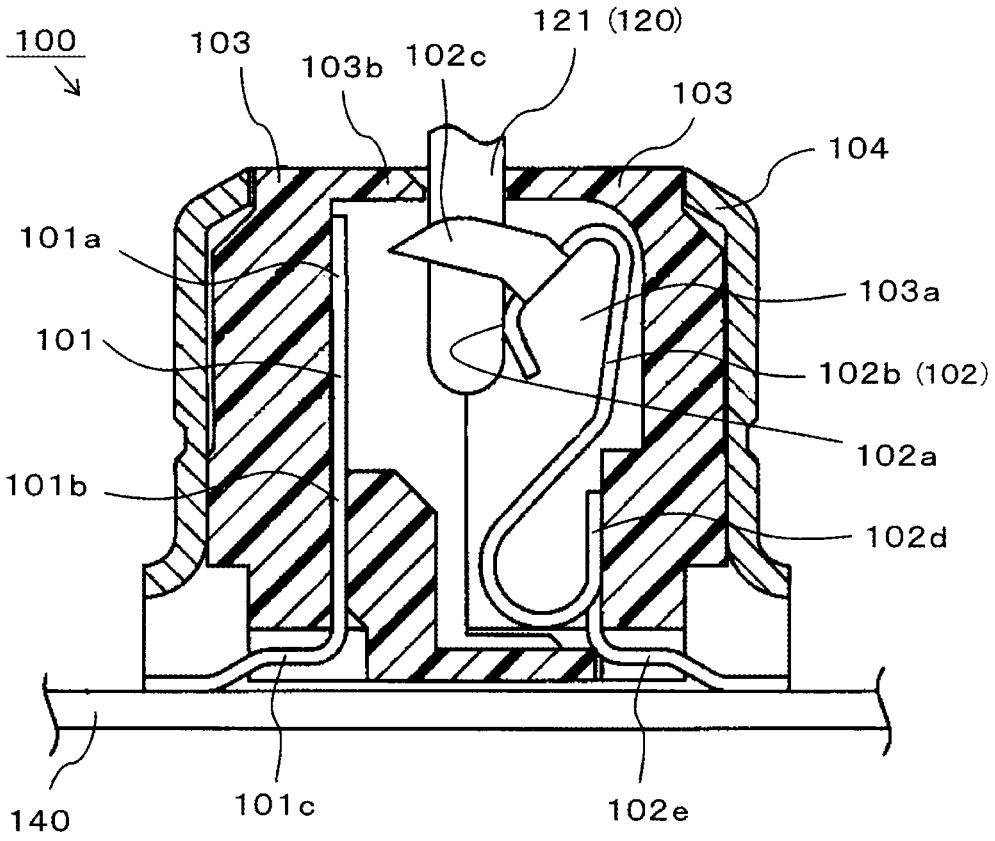
FIG. 14 PRIOR ART
FIG. 14 is an exploded perspective view illustrating the switch attached coaxial connector 100.

A conventional coaxial connector 100 which is used for such a purpose and is disclosed in Japanese Patent No. 4220446 will be described with reference to FIGS. 13 and 14. The coaxial connector 100 includes a closed terminal 101 and a common terminal 102 which are respectively formed by bending a conductive plate piece, a cylindrical insulation housing 103 which supports the terminals 101 and 102 inside a terminal accommodation chamber 103*a* while both terminals are positioned thereto, and a metal piece 104 which covers the outer lateral surface of the insulation housing 103. The upper side of the insulation housing 103 is provided with an insertion hole 103*b* which is formed by perforating so as to be inserted through the terminal accommodation chamber 103*a*, and the plug pin 121 of the coaxial plug 120 is insertable into or separable from the terminal accommodation chamber 103*a* from the upside thereof.

The closed terminal 101 which is formed by bending a conductive plate piece in a substantially L-shape is integrally provided with a fixed contact piece portion 101*a* which is disposed along the inner wall surface above the terminal accommodation chamber 103*a*, a fixed portion 101*b* which is positioned to the insulation housing 103 along the inner wall surface of the terminal accommodation chamber 103*a*, and a bridge portion 101*c* which is bent in an L-shape from the lower end of the fixed portion 101*b* and protrudes laterally along the bottom surface of the insulation housing 103, and is electrically connected to the internal antenna embedded in the device through a conductive pattern on a printed circuit board 140 connected by soldering to the bridge portion 101*c*.

The common terminal 102 is integrally provided with a plug contact portion 102*a* which is disposed along the inner wall surface of the terminal accommodation chamber 103*a* facing the closed terminal 101 with the insertion and separation path of the plug pin 121 interposed therebetween and is disposed below the insertion hole 103*b* at one side of the thin and long band-like conductive plate piece, a leaf spring piece portion 102*b* which is bent in an S-shape along the longitudinal direction of the thin and long band-like conductive plate piece, a movable contact portion 102*c* which is orthogonally bent from the side surface of the leaf spring piece portion 102*b* toward the closed terminal 101 and moves close to or away from the fixed contact piece portion 101*a*, a fixed portion 102*d* in which the base end of the leaf spring piece portion 102*b* is folded back by 180° and is press-inserted into a groove of the insulation housing 103 so as to be fixed thereto, and a bridge portion 102*e* which is bent in an L-shape from the lower end of the fixed portion 102*d* and protrudes laterally along the bottom surface of the insulation housing 103, and is connected to the transmitting and receiving circuit inside the device through a conductive pattern on a printed circuit board 140 connected by soldering to the bridge portion 102*e*.

The movable contact portion 102*c* of the common terminal 102 is biased toward the leaf spring piece portion 102*b* bent in an S-shape in a free state so as to elastically contact the fixed contact piece portion 101*a* of the closed terminal 101, and the transmitting and receiving circuit inside the device is connected to the internal antenna. When the plug pin 121 of the coaxial plug 120 connected to the external antenna is inserted from the upside of the insertion hole 103*b*, the plug pin 121 elastically contacts the plug contact portion 102*a*, and the movable contact portion 102*c* moves rearward from the fixed contact piece portion 101*a* against the elasticity of the leaf spring piece portion 102*b*, so that the connection to the transmitting and receiving circuit inside the device is switched from the internal antenna to the external antenna.

In the coaxial connector 100 with such a structure, there is a need to decrease a section modulus Z of a cross-section perpendicular to the bending direction of the leaf spring piece portion 102*b* so that a large stress causing plastic deformation is not generated in the leaf spring piece portion 102*b* of the common terminal 102. Thus, the leaf spring piece portion 102*b* is disposed in a direction perpendicular to the movement direction of the movable contact portion 102*c* so that the width of the surface becomes longer than the plate thickness thereof. Meanwhile, the fixed contact piece portion 101*a* of the closed terminal 101 disposed at the facing portion of the common terminal 102 is disposed along the inner wall surface of the terminal accommodation chamber 103*a* perpendicular to the movement direction of the movable contact portion 102*c* so that the movable contact portion 102*c* elastically contacts the fixed contact piece portion even when there is the assembling error of the common terminal 102 or the closed terminal 101 or the processing error of the leaf spring piece portion 102*a*.

As a result, the facing area between the common terminal 102 and the closed terminal 101 is large, and the isolation characteristic of the closed terminal 101 is degraded while the common terminal 102 contacts the plug pin 121, so that cross-talk with respect to the internal antenna occurs. In Japanese Patent No. 4220446, the leaf spring piece portion 102*b* of the common terminal 102 is bent in an S-shape along the longitudinal direction in order to solve this problem. Accordingly, a sufficient spring property is maintained and a long distance between the closed terminal 101 and the common terminal 102 is ensured, so that the isolation characteristic is improved.

However, the high-frequency signal which flows from the internal antenna leaks to the transmitting and receiving circuit through the floating capacitance between the closed terminal 101 and the common terminal 102, and the floating capacitance is inversely proportional to the distance between the closed terminal 101 and the common terminal 102, but is proportional to the facing area between both terminals. Accordingly, in the conventional coaxial connector 100 in which the facing area between the closed terminal 101 and the common terminal 102 is not changed and the distance therebetween is long, the isolation characteristic may not be sufficiently improved.

Further, even when the leaf spring piece portion 102*b* of the common terminal 102 is bent in an S-shape so as to ensure the distance from the closed terminal 101, the distance between the plug pin 121 contacting the plug contact portion 102*a* of the common terminal 102 and the closed terminal 101 is shortened, and the high-frequency signal of the closed terminal 101 flows to the common terminal 102 through the floating capacitance therebetween. As a result, the isolation characteristic may not be improved.

Hereinafter, a switch attached coaxial connector 1 according to an embodiment of the invention will be described with re to FIGS. 1 to 7. In FIGS. 1 to 6, the configurations of respective components constituting the switch attached coaxial connector 1 according to the embodiment are illustrated. In these drawings, Reference Numeral 3 indicates a closed terminal, Reference Numeral 4 indicates a common terminal, Reference Numeral 2 indicates an insulation housing which supports these terminals 3 and 4 while both terminals are positioned thereto, and Reference Numeral 5 indicates a cylindrical earth metal piece which covers the outer peripheral surface of the insulation housing 2. The common terminal 4 which is supported by the insulation housing 2 is a movable terminal of which a movable contact portion 4*a* moves by the insertion and the separation of a plug pin 121 of a coaxial plug 120. In the description below, a direction of biasing the movable contact portion 4*a* in a free state is referred to as the front side, a direction in which the plug pin 121 moves backward while abutting against a plug contact portion 4*b* of the common terminal 4 is referred to as the rear side, and a direction illustrated in FIG. 4 is referred to as the up and down direction and the left and right direction.

Figure 6:
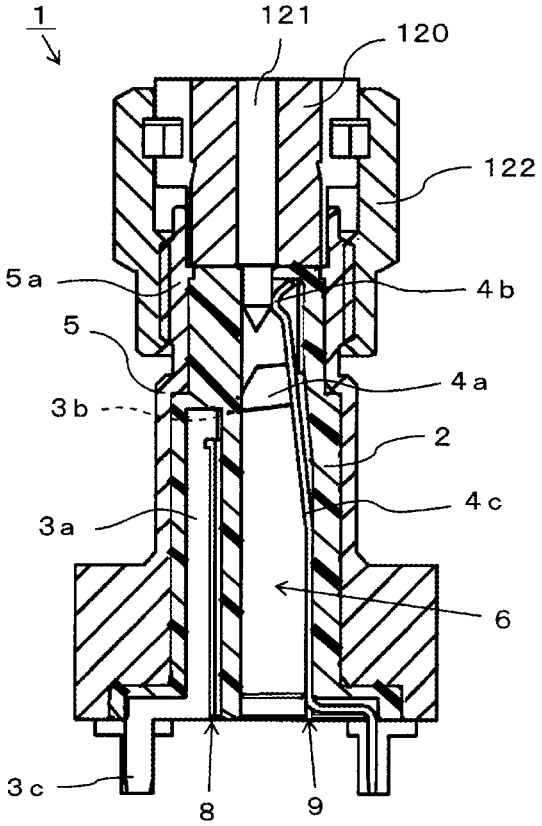
FIG. 6 is a longitudinal sectional view illustrating a state where a coaxial plug 120 is connected to the switch attached coaxial connector 1 illustrated in FIG. 5.
Figure 9A:
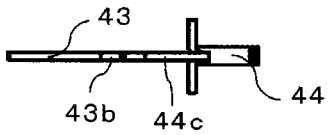
FIGS. 9A to 9D illustrate an arrangement relation between a closed terminal 43 and a common terminal 44 supported by an insulation housing 2 of a switch attached coaxial connector 40 according to a third embodiment, where
Figure 9B:
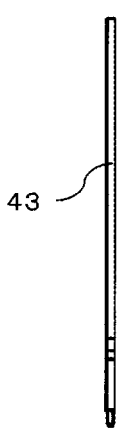
Figure 9C:
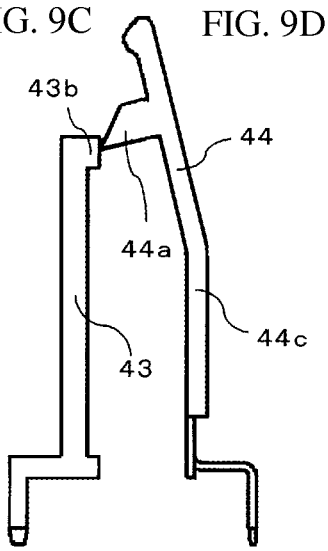
Figure 9D:
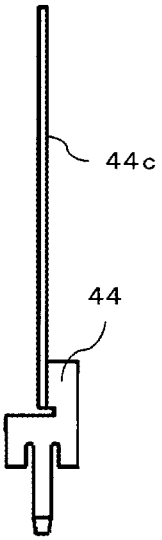
Figure 10A:
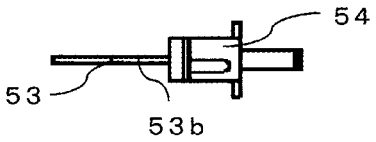
FIG. 10A is a front view illustrating both terminals.
Figure 10B:
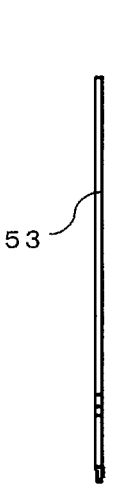
FIG. 10B is a left side view illustrating the closed terminal 53.
Figure 10C:
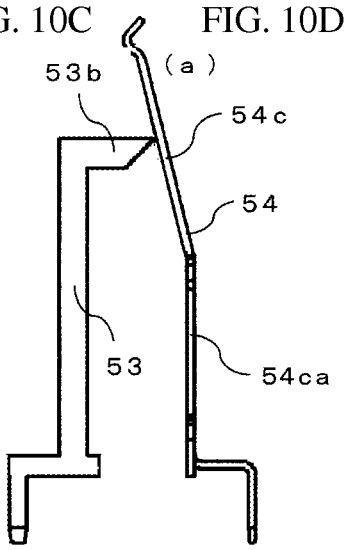
FIG. 10C is a front view illustrating both terminals.
Figure 10D:
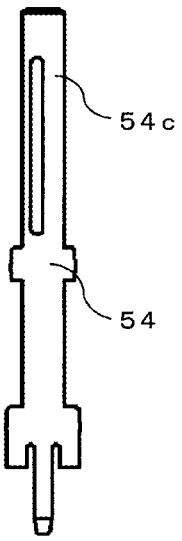
FIG. 10D is a right side view illustrating the common terminal 54.

The insulation housing 2 has a configuration in which a cylindrical housing body 2*a* and a flange portion 2*b* of the lower end of the housing body 2*a* are integrally formed with each other by an insulating synthetic resin. An insertion hole 7 which perforates the upper portion of the housing body 2*a* is formed so that the plug pin 121 of the coaxial plug 120 rotating about the center axis of the cylindrical shape is inserted therethrough. As illustrated in FIG. 6, the plug pin 121 which is inserted into the insertion hole 7 from the upside may be inserted into or separated from a terminal accommodation chamber 6 inside the housing body 2*a*.

A prismatic column portion 2*c* which has a thickness of the housing body 2*a* is formed at the front side of the terminal accommodation chamber 6 so as to follow the vertical direction from the front end of the insertion hole 7. The prismatic column portion 2*c* is provided with a fixed terminal attachment groove 8 which is formed in a concave shape until the fixed terminal attachment groove is opened to the bottom surface of the housing body 2*a* in the upright direction of the prismatic column portion 2*c*, where the fixed terminal attachment groove has an inverse L-shaped cross-section formed by a flat groove 8*a* spreading in the front to rear direction inside the prismatic column portion 2*c* and a flat relief groove 8*b* extending from the rear end thereof to the right side surface of the prismatic column portion 2*c*. Meanwhile, the rear surface of the terminal accommodation chamber 6 facing the prismatic column portion 2*c* in the front to rear direction is provided with an attachment groove 9 which is formed in the same cross-sectional shape until the attachment groove reaches the bottom surface of the housing body 2*a* in the vertical direction, and the attachment groove is used to supports a leaf spring piece portion 4*c* of the common terminal 4 to be described later while the leaf spring piece portion is positioned thereto.

Figure 3:
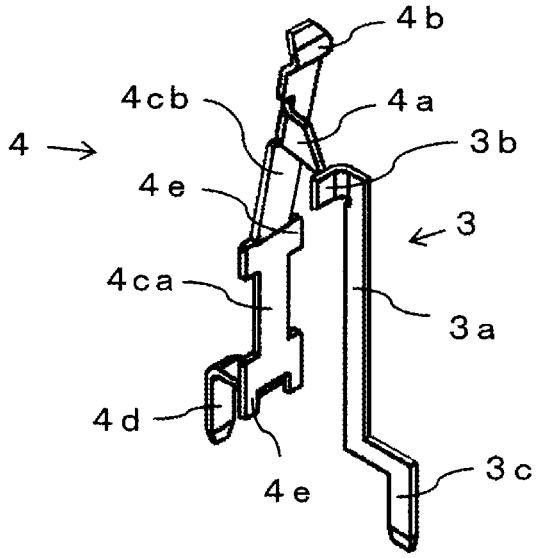
FIG. 3 is a perspective view illustrating an arrangement relation between the closed terminal 3 and the common terminal 4 supported by an insulation housing 2.
Figure 4:
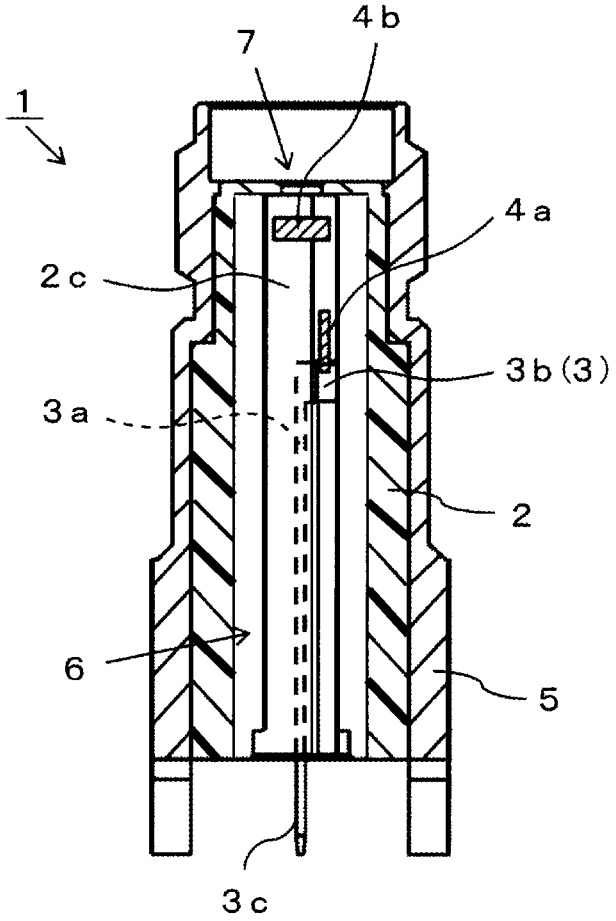
FIG. 4 is a longitudinal sectional view illustrating the switch attached coaxial connector 1 that is cut in the left and right direction perpendicular to the facing direction between the closed terminal 3 and the common terminal 4.

As illustrated in FIG. 3, the closed terminal 3 which is accommodated in the fixed terminal attachment groove 8 is formed in a manner such that a conductive thin metal piece is punched in a step shape, a fixed contact piece portion 3*b* and a crank-shaped bridge portion 3*c* are integrally formed with the upper and lower portions of the positioning piece portion 3*a* formed uprightly in a thin and long band shape, and the fixed contact piece portion 3*b* is orthogonally bent rightward from the upper portion of the positioning piece portion 3*a*. Since the direction of punching the thin metal plate becomes the plate thickness direction of the positioning piece portion 3*a*, the width of the side surface of the plate thickness direction is uniform in the plate thickness of the thin metal plate.

Figure 2:
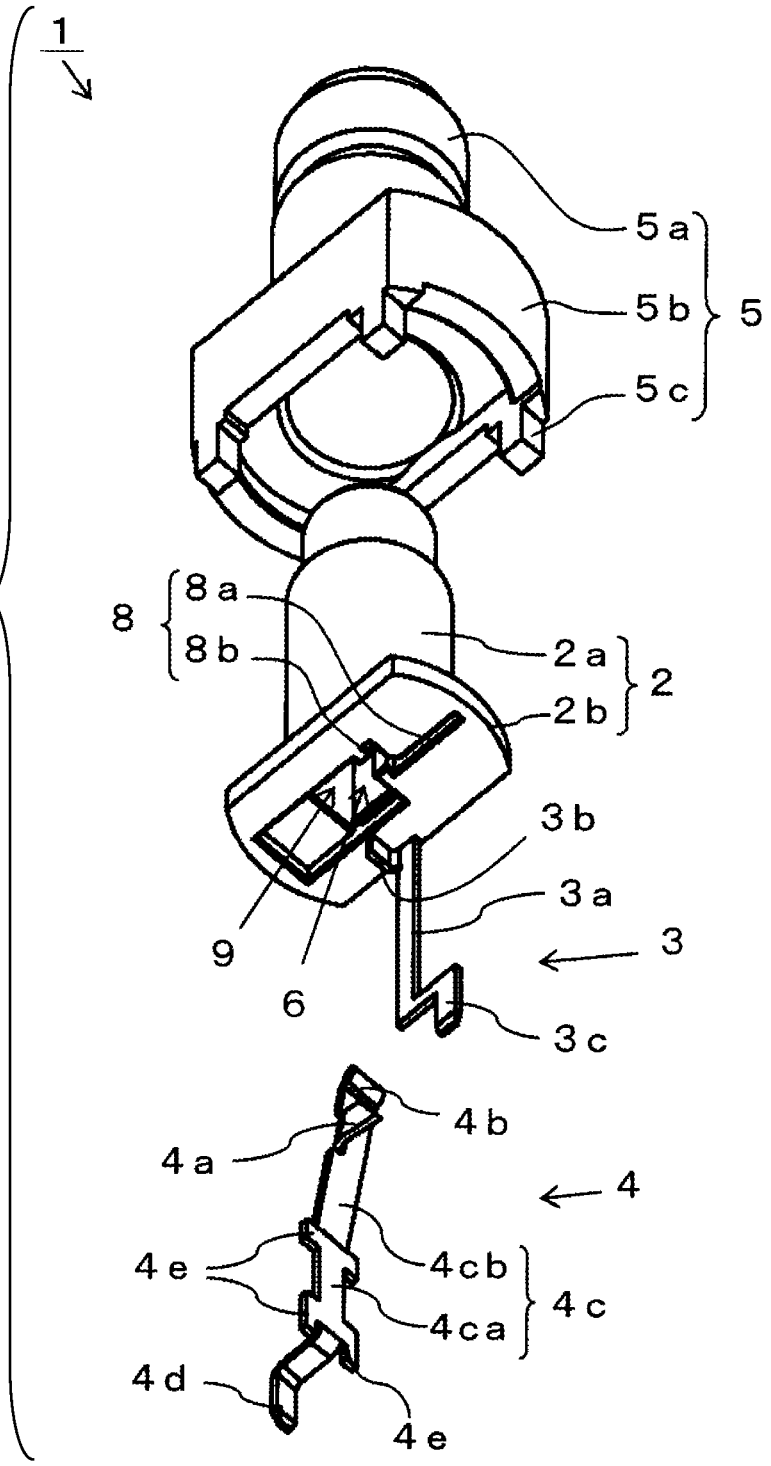
FIG. 2 is an exploded perspective view illustrating the switch attached coaxial connector 1.
Figure 5:
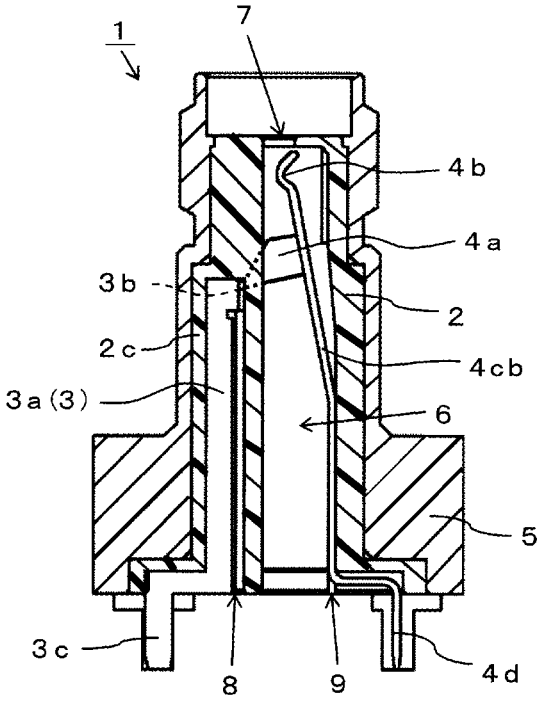
FIG. 5 is a longitudinal sectional view illustrating the switch attached coaxial connector 1 which is cut along the facing direction between the closed terminal 3 and the common terminal 4.

The width of the side surface of the positioning piece portion 3*a* in the plate thickness direction is equal to or slightly longer than the groove width of the flat groove 8*a* of the fixed terminal attachment groove 8. Then, as illustrated in FIG. 2, the closed terminal 3 is attached by press-inserting the positioning piece portion 3*a* into the flat groove 8*a* of the fixed terminal attachment groove 8 from the lower side of the housing body 2*a*. In the process of press-inserting the positioning piece portion 3*a* upward from the lower side of the flat groove 8*a*, as illustrated in FIGS. 4 and 5, the fixed contact piece portion 3*b* which is orthogonally bent rightward from the upper portion of the positioning piece portion 3*a* slides inside the flat relief groove 8*b*, and the closed terminal 3 protrudes toward the right side of the prismatic column portion 2*c* inside the terminal accommodation chamber 6 while being completely attached to the fixed terminal attachment groove 8. Since the positioning piece portion 3*a* is positioned inside the flat groove 8*a* that spreads in the front to rear direction in this attachment state, the narrow side surface faces the rear side. Further, the bridge portion 3*c* which extends downward in a crank shape from the positioning piece portion 3*a* protrudes downward from the bottom surface of the insulation housing 2.

The common terminal 4 is formed in a manner such that a thin metal plate such as phosphor bronze having a conductive property and a spring property is punched and bent in a thin and long band shape. As illustrated in FIGS. 3 and 5, the common terminal is obtained by integrally forming the leaf spring piece portion 4*c* which has a thin and long band shape, the plug contact portion 4*b* which is formed at the upper side of the leaf spring piece portion 4*c* so as to be curved forward in a semi-cylindrical shape, the planar movable contact portion 4*a* which is formed at the right upper side surface of the leaf spring piece portion 4*c* so as to be bent in a direction perpendicular to the leaf spring piece portion 4*c*, and a bridge portion 4*d* which extends in a crank shape from the lower end of the leaf spring piece portion 4*c*. The leaf spring piece portion 4*c* further includes a fixed piece portion 4*ca* which is formed at the lower side of the U-shaped portion at the center side and an inclined piece portion 4*cb* which is formed at the upper side thereof, and both side surfaces of the fixed piece portion 4*ca* are provided with locking claws 4*e* which protrude so as to be locked to the left and right inner surfaces of the attachment groove 9 of the housing body 2*a*.

As illustrated in FIG. 2, the common terminal 4 is also attached to the insulation housing 2 in a manner such that the fixed piece portion 4*ca* is inserted from the lower side of the housing body 2*a* into the attachment groove 9 and the locking claws 4*e* are locked to the left and right inner surfaces of the attachment groove 9. In a state where the common terminal 4 is positioned to the attachment groove 9, the inclined piece portion 4*cb* at the upper side of the fixed piece portion 4*ca*, the plug contact portion 4*b*, and the movable contact portion 4*a* are supported by the fixed piece portion 4*ca* in a cantilevered manner, and the movable contact portion 4*a* is biased forward by the elasticity of the leaf spring piece portion 4*c* so as to elastically contact the fixed contact piece portion 3*b* of the closed terminal 3. Further, the plug contact portion 4*b* is disposed at a position facing the rear surface of the prismatic column portion 2*c* below the insertion hole 7 in the front to rear direction at a position where the movable contact portion 4*a* elastically contacts the fixed contact piece portion 3. When the plug pin 121 of the coaxial plug 120 is inserted into the insertion hole 7 from the upside, the plug contact portion 4*b* contacts the plug pin 121 and guides the plug pin 121 in the vertical direction while sandwiching the plug pin 121 between the rear surface of the prismatic column portion 2*c* and the plug contact portion 4*b*.

The cylindrical earth metal piece 5 is formed by casting conductive zinc alloy and is formed in a cylindrical shape that covers the entire outer surface of the insulation housing 2, and includes a cylindrical earth contact portion 5*a*, an earth metal body 5*b* which abuts against the upper surface of the flange portion 2*b* of the insulation housing 2 below the earth contact portion 5*a*, and earth bridge portions 5*c* which are formed at four bottom-side corners of the earth metal body 5*b* so as to be inclined downward. The earth contact portion 5*a* covers the outer peripheral surface of the cylindrical housing body 2*a*, and contacts an external conductor 122 of the coaxial plug 120 connected to the switch attached coaxial connector 1.

In the switch attached coaxial connector 1 with such a configuration, the closed terminal 3 and the common terminal 4 are press-inserted from the lower side of the insulation housing 2 so as to be positioned to the insulation housing 2, and the cylindrical earth metal piece 5 is attached from the upper side of the insulation housing 2. Subsequently, the switch attached coaxial connector 1 is disposed on a printed circuit board (not illustrated) as a mounting target, the bridge portion 3*c* of the closed terminal 3 that protrudes toward the lower side of the insulation housing 2 is connected by soldering to a signal pattern connected to an internal antenna of a portable communication device, the bridge portion 4*d* of the common terminal 4 is connected by soldering to a signal pattern connected to a transmitting and receiving circuit of the portable communication device, and the earth bridge portion 5*c* of the cylindrical earth metal piece 5 is connected by soldering to an earth pattern. Then, when the earth bridge portions 5*c* of the cylindrical earth metal piece 5 are connected to the earth pattern of the printed circuit board, the switch attached coaxial connector 1 is mounted on the printed circuit board while the insulation housing 2 is sandwiched between the cylindrical earth metal piece 5 and the printed circuit board.

In the switch attached coaxial connector 1 which is mounted on the printed circuit board, the insertion hole 7 may be connected with the coaxial plug 120 which is disposed at the outside from the casing of the portable communication device and of which one end is connected to an external antenna. In a normal state where the switch attached coaxial connector 1 is not connected with the external antenna, as illustrated in FIG. 5, the movable contact portion 4*a* of the common terminal 4 is biased forward by the elasticity of the leaf spring piece portion 4*c* so as to elastically contacts the fixed contact piece portion 3*b*. Accordingly, the common terminal 4 is electrically connected to the closed terminal 3, and the transmitting and receiving circuit is connected to the internal antenna inside the device.

As illustrated in FIG. 6, when the plug pin 121 of the coaxial plug 120 is inserted into the insertion hole 7 so as to be connected thereto, the plug pin 121 presses the plug contact portion 4*b* rearward against the elasticity of the leaf spring piece portion 4*c* while elastically contacting the plug contact portion 4*b* of the common terminal 4 disposed at the lower side of the insertion hole 7, and the movable contact portion 4*a* moves away from the fixed contact piece portion 3*b* along with the rearward movement of the plug contact portion 4*b*. As a result, the common terminal 4 is connected to the plug pin 121 from the closed terminal 3, and the connection of the transmitting and receiving circuit is switched from the internal antenna inside the device to the external antenna.

In this way, since the closed terminal 3 and the common terminal 4 face each other in the front to rear direction of the terminal accommodation chamber 6 even when the movable contact portion 4*a* and the fixed contact piece portion 3*b* are insulated from each other, there is a possibility that cross-talk may occur in the antenna signal of the internal antenna through the floating capacitance generated between both terminals. However, in the embodiment, since the positioning piece portion 3*a* as the main portion of the closed terminal 3 is positioned inside the flat groove 8*a* spreading in the facing direction (the front to rear direction) and the narrow side surface following the punching direction faces the common terminal 4, the facing area between the common terminal 4 and the closed terminal 3 is extremely small, and the floating capacitance between both terminals reduces. Accordingly, the high isolation characteristic between the closed terminal 3 and the common terminal 4 may be ensured.

FIG. 7 is a graph illustrating a relation between the isolation characteristic and the arrangement direction of the closed terminal 3 and the common terminal 4 by a comparison, where (A) of FIG. 7 illustrates the isolation characteristic in the conventional arrangement direction in which the respective surfaces of the closed terminal and the common terminal are perpendicular to the facing direction, and (B) of FIG. 7 illustrates the isolation characteristic in the arrangement direction of the embodiment which is provided for the comparison with the conventional arrangement direction and in which the positioning piece portion 3*a* of the closed terminal 3 is parallel to the facing direction. As apparent from the comparison between (A) and (B), according to the embodiment, the high isolation characteristic between the closed terminal 3 and the common terminal 4 is ensured and the isolation characteristic of (B) is improved compared to (A) in the frequency band of the respective high-frequency signals flowing to the closed terminal 3.

As described above, the isolation characteristic with respect to the closed terminal may be improved by reducing the facing area between the closed terminal 3 and the common terminal 4 facing each other in the movement direction of the movable contact portion 4*a*. For this reason, the facing area may be further reduced by changing the shapes or the arrangement directions of the terminals as illustrated in FIGS. 8A to 11D on the condition in which the basic functions of the closed terminal and the common terminal are not degraded compared to the first embodiment in which the positioning piece portion 3*a* of the closed terminal 3 is parallel to the facing direction. Furthermore, in these drawings, in order to clarify the shapes or the arrangement directions of the closed terminal and the common terminal, the insulation housing or the cylindrical earth metal piece are not illustrated in the drawings, and the closed terminal and the common terminal are illustrated in the respective normal directions in a normal state where the coaxial plug 120 is not connected to the switch attached coaxial connector.

FIGS. 8A to 8D illustrate a closed terminal 33 and a common terminal 34 of a switch attached coaxial connector 30 according to a second embodiment in which the portion corresponding to the fixed piece portion 4*ca* of the common terminal 4 of the switch attached coaxial connector 1 according to the first embodiment is formed as an intersection plate portion 34*ca* which is disposed in parallel to the facing direction. In the second embodiment, since the intersection plate portion 34*ca* which is fixed to the insulation housing so as not to be elastically deformed in the leaf spring piece portion 34*c* of the common terminal 34 is set to be parallel to the facing direction of the closed terminal 33, it is possible to further reduce the facing area between the closed terminal 33 and the common terminal 34 without influencing the spring property of the common terminal 34. (C) of FIG. 7 illustrates the isolation characteristic between the closed terminal 33 and the common terminal 34 of the switch attached coaxial connector 30. Here, as apparent from the comparison with (A) and (B), according to the second embodiment, the isolation characteristic of (C) may be further improved compared to (B) of FIG. 7.

FIGS. 9A to 9D illustrate a switch attached coaxial connector 40 according to a third embodiment in which an entire leaf spring piece portion 44*c* of a common terminal 44 and a fixed contact piece portion 43*b* of a closed terminal 43 are disposed in parallel to the facing direction compared to the switch attached coaxial connector 30 according to the second embodiment. Since the leaf spring piece portion 44*c* of the common terminal 44 is disposed in parallel to the movement direction of the movable contact portion 44*a*, the section modulus Z in the bending direction increases, but all the side surfaces of the main portions of the common terminal 44 and the closed terminal 43 face each other. Accordingly, the isolation characteristic may be drastically improved.

FIGS. 10A to 10D illustrate a closed terminal 53 and a common terminal 54 of a switch attached coaxial connector 50 according to a fourth embodiment in which the portion corresponding to the fixed contact piece portion 3*b* of the closed terminal 3 is formed as a fixed contact piece portion 53*b* disposed in parallel to the facing direction and a leaf spring piece portion 54*c* also serves as the movable contact portion 4*a* of the common terminal 4 while the movable contact portion 4*a* is removed compared to the switch attached coaxial connector 1 according to the first embodiment. In the fourth embodiment, since the fixed contact piece portion 53*b* is disposed in parallel to the facing direction, the facing area with respect to the common terminal 4 reduces. Further, since the leaf spring piece portion 54*c* of the closed terminal 53 also serves as the movable contact portion, the separate movable contact portion do not need to face the closed terminal 53, and hence the facing area between both terminals further reduces.

FIGS. 11A to 11D illustrate a closed terminal 63 and a common terminal 64 of a switch attached coaxial connector 60 according to a fifth embodiment in which the portion corresponding to the fixed piece portion 54*ca* of the common terminal 54 is formed as a intersection plate portion 64*ca* disposed in parallel to the facing direction compared to the switch attached coaxial connector 50 according to the fourth embodiment. In the fifth embodiment, since the intersection plate portion 64*ca* which is fixed to the insulation housing so as not to be elastically deformed is parallel to the facing direction of the closed terminal 63, the facing area between the closed terminal 63 and the common terminal 64 may be reduced without influencing the spring property of the common terminal 64, and hence the isolation characteristic may be improved.

In the above-described embodiments, the positioning piece portion as the main portion of the closed terminal is positioned to the insulation housing in the facing direction as the front to rear direction of the leaf spring piece portion as the main portion of the common terminal. However, the positioning piece portion may be fixed to the insulation housing as the portion deviated from the facing portion with respect to the common terminal so that only the fixed contact piece portion is bent from the positioning piece portion to the portion facing the movable contact portion. Since the positioning piece portion of the closed terminal is disposed at the portion deviated from the facing portion with respect to the common terminal, the gap between both terminals increases, and the facing area between the closed terminal and the common terminal of which the planes are perpendicular to the facing direction reduces.

Further, in the above-described respective embodiments, an example has been described in which the closed terminal and the common terminal are attached to the insulation housing by press-inserting, but both terminals may be fixed to the insulation housing by integral molding.

The invention is suitable for the switch attached coaxial connector that is used to change the high-frequency signal.

What is claimed is:

1. A switch attached coaxial connector comprising:

an insulation housing that is provided with a terminal accommodation chamber and an insertion hole through which a plug pin of a coaxial plug is insertable into or separable from the terminal accommodation chamber from the upside thereof;

a normal close terminal that is formed of a conductive plate piece and is integrally provided with a fixed contact piece portion and a positioning piece portion, both supported by the insulation housing in the plug pin insertion and separation direction inside the terminal accommodation chamber; and a common terminal that is formed of a conductive plate piece and is integrally provided with a plug contact portion which is disposed below the insertion hole, a movable contact portion which is movable close to or away from the fixed contact piece portion of the normal close terminal, and a leaf spring piece portion which is supported by the insulation housing in a cantilevered manner along the plug pin insertion and separation direction inside the terminal accommodation chamber and biases the movable contact portion toward the fixed contact piece portion, wherein in a normal state where the coaxial plug is not connected to the switch attached coaxial connector, the movable contact portion biased by the leaf spring piece portion elastically contacts the fixed contact piece portion so that the normal close terminal and the common terminal are electrically connected to each other, when the coaxial plug is connected to the switch attached coaxial connector, the movable contact portion moves rearward from the fixed contact piece portion by the plug pin abutting against the plug contact portion so that the contact with respect to the fixed contact piece portion is disconnected and the electrical connection of the common terminal is switched from the normal close terminal to the plug pin, and wherein when fully assembled, a side surface of the positioning piece portion located in a plate thickness direction of the positioning piece portion faces in parallel to a facing surface of the leaf spring piece portion of the common terminal in a movable direction of the movable contact portion.

2. The switch attached coaxial connector according to claim 1, wherein the leaf spring piece portion of the common terminal is provided with an intersection plate portion in which the plate thickness direction of the conductive plate piece is parallel to the facing surface.

3. The switch attached coaxial connector according to claim 2, wherein the movable contact portion of the common terminal extends to the intersection plate portion so that the plate thickness direction is parallel to the facing surface.

4. The switch attached coaxial connector according to any one of claim 1, wherein the positioning piece portion of the normal close terminal is supported by the insulation housing at a side deviated from a portion facing the common terminal in a movable direction of the movable contact portion, and the fixed contact piece portion is formed so as to be orthogonally bent relative to a portion facing the movable contact portion from the positioning piece portion.

5. The switch attached coaxial connector according to any one of claim 1, wherein the fixed contact piece portion of the normal close terminal extends to the positioning piece portion so that the plate thickness direction is parallel to the facing surface.

6. The switch attached coaxial connector according to claim 1, wherein when one side of the common terminal is connected to a transmitting and receiving circuit of a portable communication device so that the coaxial plug is connected to the switch attached coaxial connector, the electrical connection of the other side of the common terminal is switched from the normal close terminal connected to an internal antenna to the plug pin connected to an external antenna.

7. The switch attached coaxial connector according to any one of claim 2, wherein the positioning piece portion of the normal close terminal is supported by the insulation housing at a side deviated from a portion facing the common terminal in the movable direction of the movable contact portion, and the fixed contact piece portion is formed so as to be orthogonally bent relative to a portion facing the movable contact portion from the positioning piece portion.

8. The switch attached coaxial connector according to any one of claim 2, wherein the fixed contact piece portion of the normal close terminal extends to the positioning piece portion so that the plate thickness direction is parallel to the facing surface.

9. The switch attached coaxial connector according to any one of claim 3, wherein the positioning piece portion of the normal close terminal is supported by the insulation housing at a side deviated from a portion facing the common terminal in the movable direction of the movable contact portion, and the fixed contact piece portion is formed so as to be orthogonally bent relative to a portion facing the movable contact portion from the positioning piece portion.

10. The switch attached coaxial connector according to any one of claim 3, wherein the fixed contact piece portion of the normal close terminal extends to the positioning piece portion so that the plate thickness direction is parallel to the facing surface.

* * * * *